United States Patent [19]

Molnar

[11] Patent Number: 4,799,136

[45] Date of Patent: Jan. 17, 1989

[54] LIGHTING FIXTURE HAVING CONCAVE SHAPED REFLECTOR AND IMPROVED ASYMMETRIC LIGHT REFLECTION SYSTEM

[75] Inventor: John P. Molnar, St. Louis, Mo.

[73] Assignee: Guth Lighting Systems, Inc., St. Louis, Mo.

[21] Appl. No.: 56,406

[22] Filed: May 29, 1987

[51] Int. Cl.[4] ..... F21V 7/00

[52] U.S. Cl. ..... 362/300; 362/347

[58] Field of Search ..... 362/217, 223, 260, 297, 362/299, 300, 310, 347, 348, 16

[56] References Cited

U.S. PATENT DOCUMENTS

| | | | |
|---|---|---|---|
| 1,759,307 | 5/1930 | Hartinger | 362/348 |
| 2,341,658 | 2/1944 | Salani | 362/297 |
| 4,081,667 | 3/1978 | Lewin et al. | 362/348 |
| 4,349,866 | 9/1982 | Molnar | 362/348 |
| 4,358,816 | 11/1982 | Soileau | 362/348 |
| 4,360,863 | 11/1982 | Barnes et al. | 362/217 |

*Primary Examiner*—Charles J. Myhre

*Assistant Examiner*—David A. Okonsky

*Attorney, Agent, or Firm*—Nicholas L. Coch

[57] ABSTRACT

A lighting fixture adapted for uniformly illuminating a wall surface by utilizing an asymmetric light reflection pattern. The fixture includes a support housing and an elongated concave-shaped reflector which is pivotably attached to the support housing and has multiple facet surfaces arranged for reflecting light from the centrally located light source out through a front opening, which is covered with an ultraviolet filtering glass diffusion plate. The reflector has major rear and minor front reflecting portions, each portion containing multiple facet surfaces arranged in upper and lower zones with varying angles measured relative to a central vertical plane selected for reflecting light from the light source uniformly out through the diffusion plate to provide an asymmetric lighting pattern for uniformly illuminating a wall surface. The lighting fixture is usually mounted from a ceiling and directed to uniformly illuminate a vertical wall surface so as to avoid hot spots, scallops and striations on the illuminated surface.

7 Claims, 5 Drawing Sheets

LIGHTING FIXTURE HAVING CONCAVE SHAPED REFLECTOR AND IMPROVED ASYMMETRIC LIGHT REFLECTION SYSTEM

BACKGROUND OF INVENTION

This invention pertains to lighting fixtures having an improved reflector and light reflection system. It pertains particularly to a lighting fixture having a light source and an elongated concave shaped reflector containing multiple reflective facets, with their angles selected to provide uniform illumination for a wall surface.

Various lighting systems for illumination of room areas and wall surfaces have been previously disclosed which utilize an elongated housing containing a light source and a concave curved reflector. For example, a lighting fixture for illuminating planar surfaces and adapted for recessed ceiling mounting using circular shaped reflectors is shown in U.S. Pat. No. 3,643,089 to Marantz. Also, light fixtures which include a rectangular shaped housing containing a continuous curved reflector and light source for illuminating a wall surface are shown in U.S. Pat. No. 3,679,893 to Shemitz et al; U.S. Pat. No. 4,027,151 to Barthel; and U.S. Pat. No. 4,229,779 to Bilson et al. A lighting device having a reflector with specially shaped curved surfaces is shown in U.S. Pat. No. 3,413,460 To Sjolander. Also, a lighting system utilizing an elongated asymmetric reflector containing multiple facets is shown in U.S. Pat. No. 4,349,866 to Molnar, for providing indirect lighting to a ceiling surface. However, it has been found that these illuminating devices and systems do not provide sufficient light intensity and uniformity when directly illuminating wall surfaces and objects without causing scallops, striations or hot spots in the illumination patterns. Thus, further improvements in such lighting systems are desired for producing more uniform direct illumination of wall surfaces.

SUMMARY OF INVENTION

This invention provides an improved lighting fixture having a concave shaped reflector especially designed for directly and uniformly illuminating wall surfaces. The lighting fixture includes an elongated rectangular shaped housing adapted for being attached to a support means, the housing being pivotably attached at its lower side to an elongated reflector having a special concave shape, and a light source centrally located within the reflector so that it is substantially enclosed by the reflector walls. The reflector has a lower opening covered by an ultraviolet filtering glass diffusion plate retained in dual slots provided in the reflector walls adjacent this opening. The light source is centrally located and supported within the reflector and includes at least one lamp which can be either a tungsten, quartz or metal halide type lamp, or combinations thereof. The reflector is covered at each end by an end plate removably attached to the reflector.

The concave-shaped reflector includes a major length rear portion and a minor length front portion, with each portion having multiple inner reflecting facet surfaces which face towards each other. Each portion of the reflector is provided in upper and lower zones with multiple specially angled reflecting facet surfaces which reflect light from the source out through a front opening in the reflector in a uniform asymmetric pattern. Light is reflected from the reflector facet surfaces in the major length rear portion directly outwardly through the opening and glass diffusion plate, while some of the facet surfaces on the minor length front portion reflect light partially against facets in the opposite major length portion of the reflector.

If desired, the fixture housing located above the reflector can provide space for ballast and capacitors as required. The fixture housing can be adapted for either pendant type mounting below a ceiling, flush mounting against a ceiling, or for recessed mounting of the fixture housing within a ceiling structure.

This invention advantageously provides a compact and efficient lighting fixture in which the light rays emanating from the light source are reflected in a controlled asymmetric pattern so as to provide a balanced and uniform illumination of a wall surface without producing visible scallops, striations or hot spots on the illuminated surface.

BRIEF DESCRIPTION OF DRAWINGS

This invention will be further described with reference to the following drawings, in which.

DESCRIPTION OF INVENTION

Figure 1:
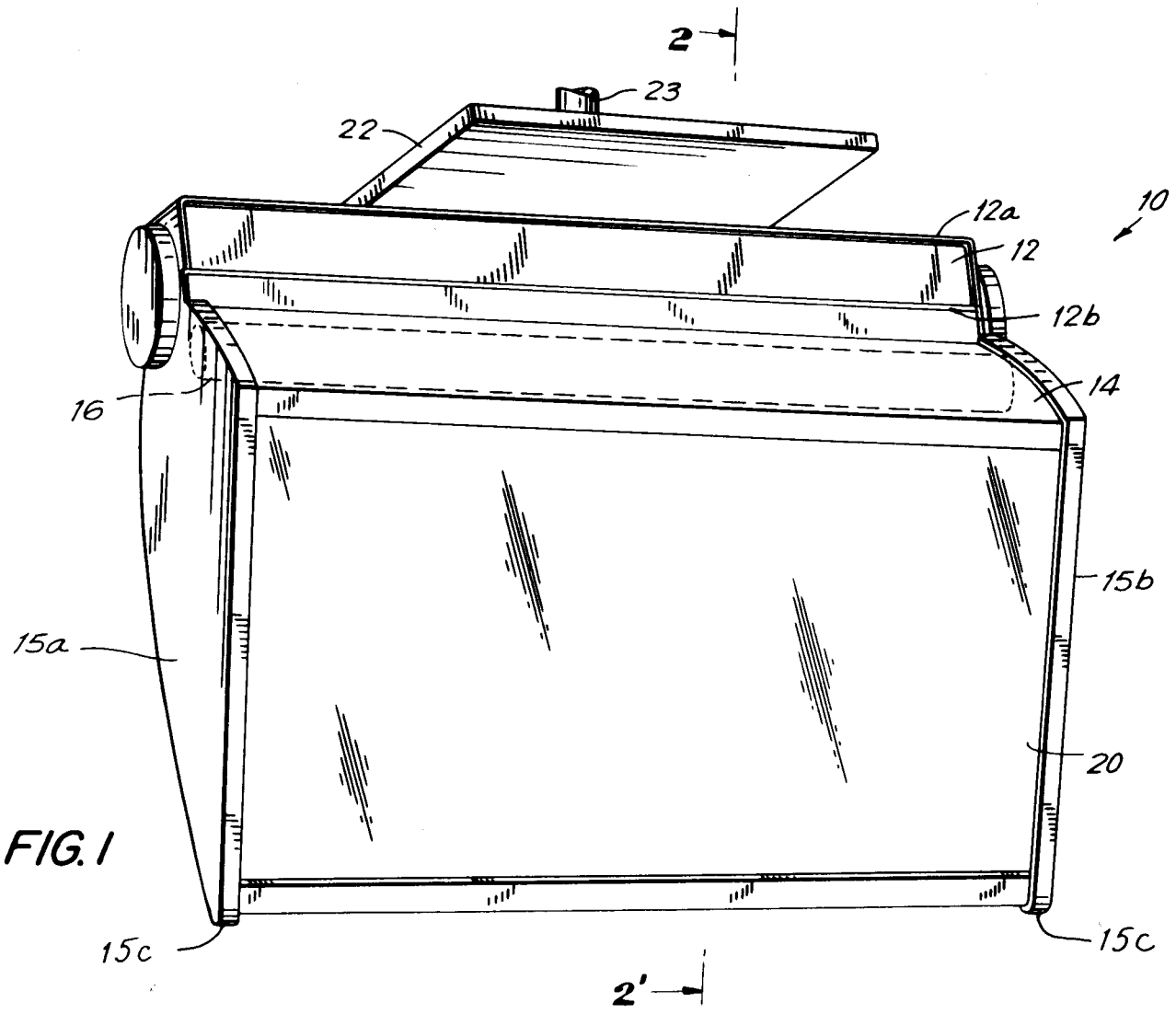
FIG. 1 shows a perspective view of a lighting fixture constructed in accordance with the present invention.
Figure 2:
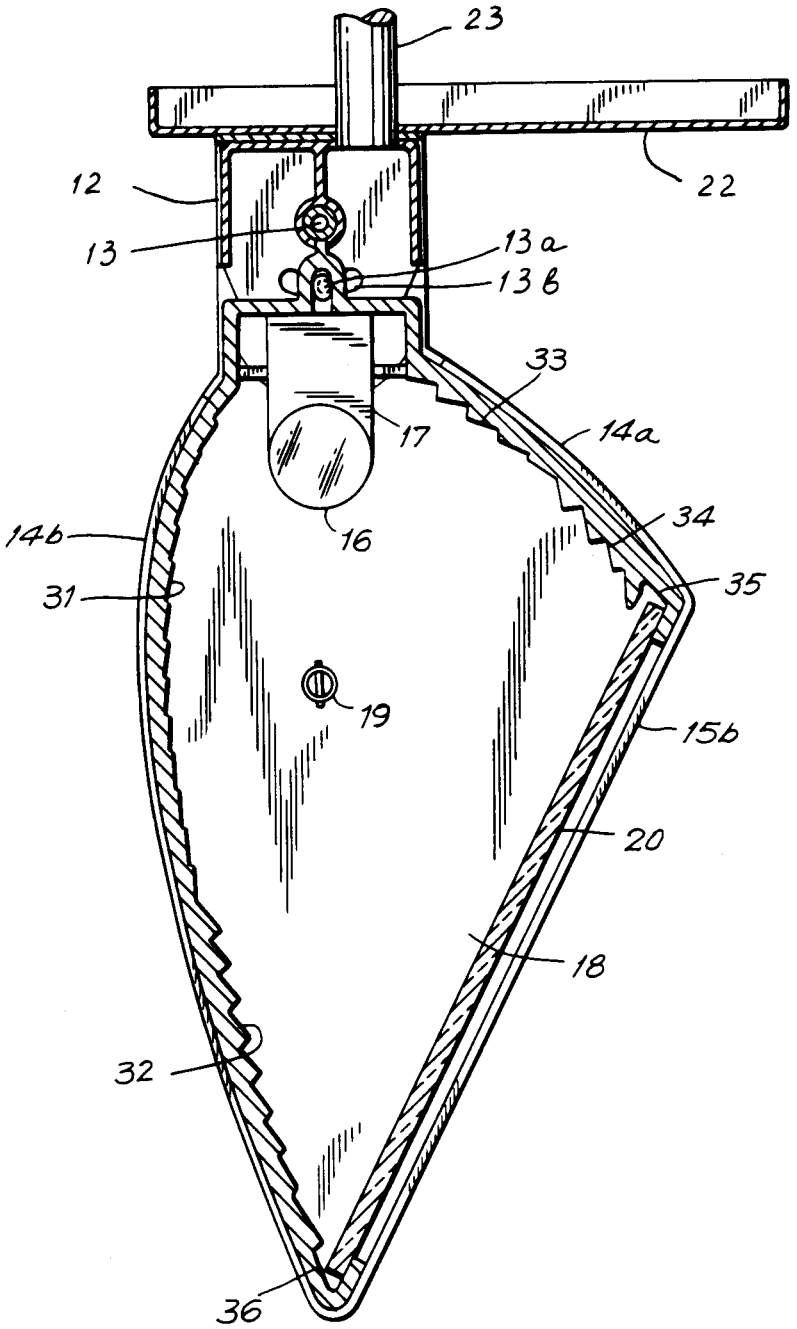
FIG. 2 shows a sectional view taken at line 2—2' of FIG. 1 and generally showing the reflecting facet surface configuration and diffusion plate of the reflector.

As is generally shown by FIGS. 1 and 2, the light fixture 10 includes an elongated housing 12 adapted for being suitably supported, usually from its upper side **12*a*. The housing is pivotably attached at its lower side 12*b* to a reflector 14, which has a generally concave shape including a minor length front portion 14*a* and a major length rear portion 14*b*. The reflector 14 is pivotably attached to housing 12 by a pivot means 13, and can be locked in a desired swiveled position by a locking screw 13*a* and elongated slot 13*b* in the housing 12**.

The reflector 14 is provided at each end with end covers **15*a* and 15*b* which are each removably attached to the reflector. An elongated light source 16 is provided centrally located within the reflector 14 and is supported from the reflector by a bracket 17 fixedly attached to the reflector, as is best shown in FIG. 2. The light source 16 can be provided by at least one quartz and/or metal halide type lamp, with two lamps usually being preferred to provide a desired blend of light coloration, good lumen output and compact bulb size. The reflector 14 has a front opening 18 which is covered by a substantially flat tempered glass plate 20, which filters ultraviolet light and is etched on one side to diffuse the light emanating from the lamp 16** and reflecting surfaces of the reflector.

The end covers or plates 15*a* and 15*b* may each be provided with an inwardly oriented lip 15*c* which fits around the ends of the reflector 14 and glass plate 20. The end cover plates may be held in place against reflector 14 by an interior tension spring 19 connected to the inner side of each cover, as generally shown by FIG. 2. Alternatively, the reflector end plates 15*a* and 15*b* may each be attached to reflector 14 by screw fasteners (not shown).

Figure 3:
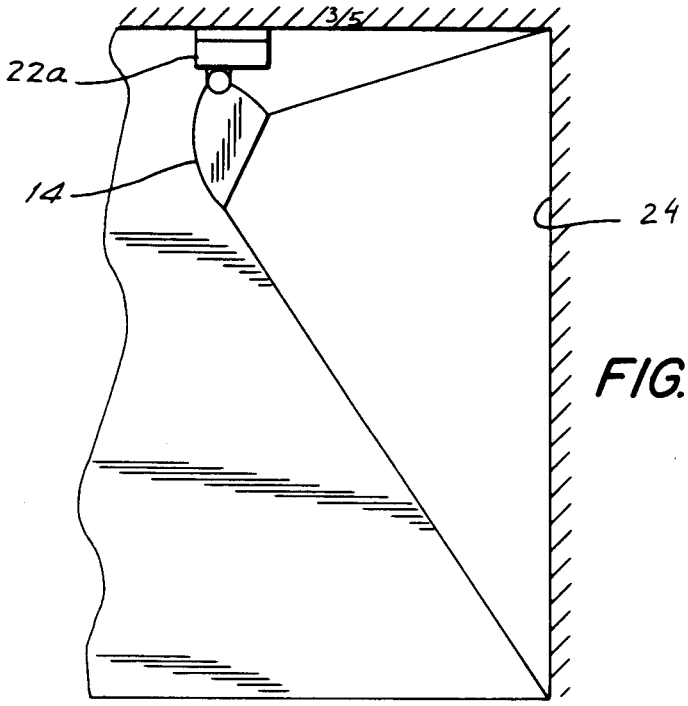
FIG. 3 shows a typical application and installation of the lighting fixture mounted below a ceiling and illuminating a vertical wall surface.
Figure 4:
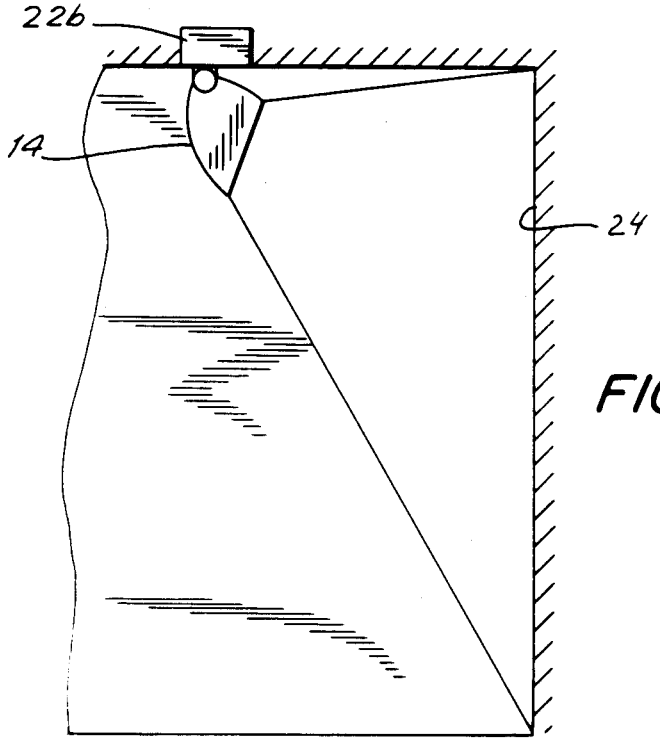
FIG. 4 shows another typical installation of the lighting fixture similar to FIG. 3 but partially recessed into a ceiling.

The housing 12 is attached to an outlet box cover 22. The housing 12 can be supported from a pendant 23 as generally shown by FIG. 1, or support structure 22*a* can be attached flush against a ceiling and the reflector 14 pivoted vertically relative to the housing so as to uniformly illuminate a wall surface 24, as shown by FIG. 3. Alternatively, support structure 22*b* can be semi-recessed into a ceiling structure as shown by FIG. 4. The support structures 22*a*, 22*b* can be enlarged sufficiently to include ballast and capacitor means as required for metal halide type lamps, similarly as shown by FIGS. 3 or 4.

Figure 5:
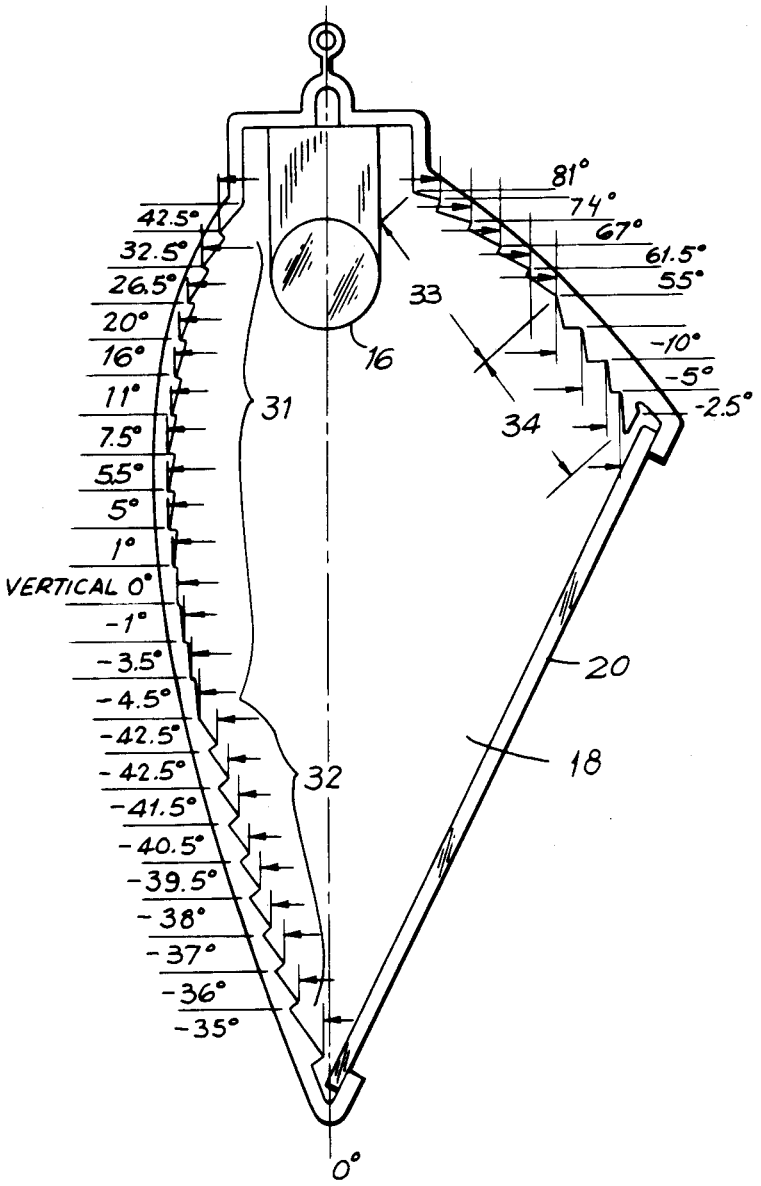
FIG. 5 is a sectional diagram taken at line 2—2' of FIG. 1 showing the various facet angles of the reflector.
Figure 6:
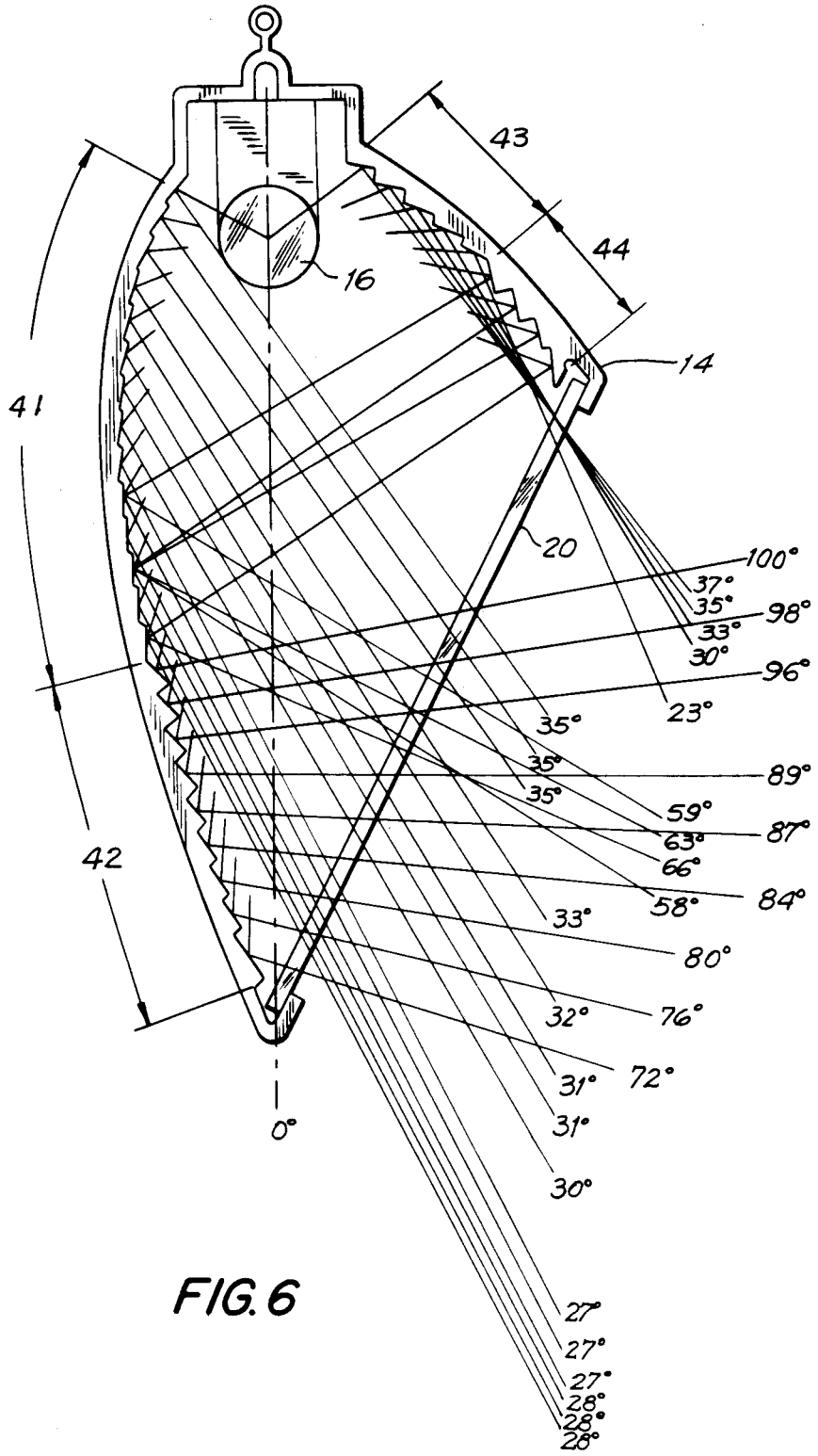
FIG. 6 is a diagram similar to FIG. 5 showing the various facet angles of the reflector and the resulting light beam pattern reflected out through the reflector opening onto a wall surface to be illuminated.

The reflector 14 is concave shaped and is provided with multiple reflecting facets so as to provide an improved asymmetric light reflection system. The reflector inner walls, comprised of a major length rear portion 31, 32 and a minor length front portion 33, 34 of the reflector, are each provided with a plurality of reflecting facet surfaces and connecting surface segments located in upper 31, 33 and lower 32, 34 zones in each portion of the reflector. As is generally shown in FIGS. 2 and 6, the major length rear upper zone 31 of reflector 14 is provided with 14 reflector facet surfaces wherein such surfaces each have a decreasing angle of from about 45° to about −5° when measured with respect to a central vertical plane through the reflector with positive acute facet angles inclined from the parallel vertical reference line towards the light source 16 and negative acute facet angles inclined from the parallel vertical reference line away from light source 16. These angles are selected to reflect light from source 16 out through the front opening 18 of the reflector and through glass diffuser plate 20 in substantially parallel lines or rays onto the bottom and central portions of the wall to be illuminated, as shown by the FIG. 6 lighting diagram. The major length rear lower zone 32 of reflector 14 contains 9 facet surfaces which each have an decreasing negative angle from about 45° to about −30° when measured relative to the central vertical plane of the reflector as shown by FIG. 5. These lower zone facet angles are selected to reflect light from the source 16 out front opening 18 and diffuser plate 20 in substantially parallel lines or rays onto the central and upper portions of a wall surface 24 to be illuminated, as shown by the FIG. 6 lighting diagram. Referring again to FIGS. 2 and 5 the minor length front upper zone 33 of reflector 14 contains 5 facet surfaces which each have a decreasing angle from about 85° to about 50° when measured relative to the central vertical plane of the reflector. These upper zone facet angles are selected to reflect light from source 16 out through the opening 18 so as to converge at approximately the upper portion of the opening 18 and to diverge on the central and upper portions of the wall surface 24 to be illuminated as shown by the FIG. 6 lighting diagram. Additionally, the minor length front lower zone 34 contains 4 adjacent facet surfaces, which each have a further decreasing angle from about 10° to about 0° when measured relative to the central vertical plane, as shown by FIG. 5. These lower zone facet angles are selected so as to reflect light from source 16 back onto the lower portion of the major length rear upper zone 31, then out through the opening 18 and glass plate 20 onto the central portion of the wall surface 24 to be illuminated, as shown by the FIG. 6 lighting diagram. It being appreciated that this consistent system of angle measurement is with respect to reference lines parallel to the central vertical plane through the light source and an end of the reflection as shown in FIGS. 5 and 6 defining facet surfaces generally inclined toward the central vertical plane.

Thus, the multiple facets and reflecting surfaces of reflector 14 are designed to provide an increased number of reflecting facets having varying angles selected so as to provide a significant increase in light ray intersections, thereby producing an improved asymmetric light pattern which provides uniform distribution of light rays onto a wall to be illuminated and provides relatively sharp cutoff of light at ceiling and floor lines, as is generally shown by FIGS. 3 and 4.

The various facet angles of the reflector 14 and the resultant pattern of light beams reflected from various zones of the reflector out through the opening 18 and the glass diffuser plate 20 are shown by the FIG. 6 lighting diagram. It is seen that in the upper rear portion of the reflector 14, the light beams from the facet surfaces at 41 are all reflected directly out through opening 18 and glass plate 20, while in the lower rear portion the light beams from the facet surfaces at 42 are reflected outwardly through opening 18 so as to intersect the light beams from the facet surfaces at 41. Similarly, in the upper front portion of the reflector 14, light beams from the facet surfaces at 43 are reflected directly outwardly through opening 18 and glass plate 20, while in the lower front portion the light beams from the facet surfaces at 44 are reflected so as to enhance and intersect the beams from the facet surfaces at 41. By this arrangement of reflecting facet surfaces, the resulting pattern of light beams from reflector 14 provides a uniform light distribution pattern on any surface being illuminated by the light fixture 10.

The improved light intensity distribution pattern provided by the light fixture 10 when directed against a wall surface generally shown by FIGS. 3 and 4 is provided in Table 1 below. This table shows a typical distribution pattern of light as measured in foot candles from a 70 watt lamp on a vertical wall surface, with the fixture being mounted 2.5 ft. from the vertical wall. It is noted that the light intensity variation over the illuminated wall area is substantially uniform without any localized areas having a greater illumination intensity than adjacent portion of the wall.

TABLE 1

Light Distribution Pattern From 70 Watt Lamp in Foot Candles

| Vertical Distance From Lamp - ft. | Horizontal Distance from Lamp - ft. | | | | | | | |
|---|---|---|---|---|---|---|---|---|
| 0 | 0 | 1 | 2 | 3 | 4 | 5 | 6 | 7 |
| 1 | 125 | 85 | 35 | 10.5 | 3.5 | 2.0 | 1.0 | 0.3 |
| 2 | 150 | 111 | 49 | 12.5 | 4.0 | 2.0 | 1.0 | 0.6 |
| 3 | 81 | 62 | 30.5 | 10.5 | 4.5 | 2.0 | 1.0 | 0.5 |
| 4 | 30 | 22 | 14 | 7.0 | 3.0 | 1.5 | 1.0 | 0.5 |
| 5 | 10 | 8.5 | 6 | 3.0 | 2.0 | 1.0 | 0.5 | 0.3 |
| 6 | 4 | 3.5 | 2.5 | 2.0 | 1.5 | 1.0 | 0.5 | 0.3 |
| 7 | 2 | 1.8 | 1.5 | 1.0 | 1.0 | 0.5 | 0.5 | 0.2 |
| 8 | 1 | 1 | 1 | 0.5 | 0.5 | 0.5 | 0.3 | 0.2 |
| 9 | 0.5 | 0.5 | 0.5 | 0.5 | 0.5 | 0.5 | 0.2 | 0.2 |

The reflector 14 can be made of any material which is dimensionally stable, heat resistant, and can be polished or plated on its inner surfaces to be highly reflective, such as glass, aluminum, brass, stainless steel, and the like whether in cast or sheet form. The reflector is preferably made of extruded aluminum alloy about 0.090–0.110 inches minimum thickness and has polished or satin finish inside reflector surfaces. The light source 16 located within the reflector 14 is preferably provided by two elongated bulbs or lamps, which for example can be a 150 watt tungsten halogen and 70 watt M-85 HQI metal halide type lamp. The glass plate diffuser 20 is made of tempered glass which is capable of filtering ultraviolet light, and etched on at least one side for providing a more uniform light distribution. The plate 20 is retained within the front opening 18 and reflector 14 by grooves 35 and 36 provided at the lower sides of the reflector 14, and plate 20 is covered at each end by the removable cover plates 15*a* and 15*b*.

The invention will now be further described by the following examples of lighting fixtures, which should not be construed as limiting the scope of the invention.

EXAMPLE 1

A pendant type light fixture is constructed having an elongated concave-shaped extruded aluminum reflector and dual end cover plates made of die cast aluminum removably attached to the reflector by screws. The reflector includes a major length rear portion and a minor length front portion, each portion containing a plurality of inner facing reflecting facet surfaces arranged in an upper zone and a lower zone. In the reflector major length rear portion the facets in the upper zone have decreasing angles measured relative to a central vertical plane, and in the lower zone have decreasing negative angles measured relative to the vertical plane. In the reflector minor length front portion, facets in the upper zone have decreasing angles measured relative to the vertical plane, and in the lower zone they have further decreasing angles measured relative to the vertical plane. The light source is a 150 watt tungsten halogen lamp centrally located and supported within the reflector. The cover glass attached to the reflector in dual grooves is a flat etched solar glass plate capable of filtering ultraviolet light. Support for the fixture is provided by a conduit attached to the upper part of the housing structure. The lighting fixture has dimensions of 9 inches long, 4 inches wide, and 8 inches high and is suspended below a ceiling generally as shown by FIG. 3, so as to uniformly illuminate an adjacent vertical wall surface. The reflector is made of extruded aluminum 0.090–0.110 inch minimum thickness with the inner facet surfaces being highly reflective.

EXAMPLE 2

A ceiling mounted light fixture is provided having an elongated concave-shaped extruded aluminum reflector and dual end cover plates made of die cast aluminum. The reflector has rear primary and front secondary portions which contain a plurality of reflective facet control surfaces arranged similarly as for Example 1. The light source is a metal halide lamp centrally located at the focal point of the reflector, with ballast and capacitance means being provided in a housing located above the reflector. A cover glass attached to the reflector opening is an etched solar glass plate capable of filtering ultraviolet light. The light fixture is attached to a ceiling and the reflector is pivoted relative to the fixture housing so as to uniformly illuminate an adjacent wall surface. The lamp fixture has dimensions 9 inches long, 5 inches wide, and 12 inches high. The reflector is made of extruded aluminum 0.090–0.110 inch minimum thickness with the inner facet surfaces being highly reflective.

Although this invention has been described broadly and in terms of a preferred embodiment, it will be understood that modifications and variations may be made within the scope of the invention, which is defined by the following claims.

What is claimed is:

1. A lighting fixture adapted for uniformly illuminating a substantially vertical wall surface of a room having upper, central and bottom portions, the fixture comprising:

(a) an elongated housing having a lower side and adapted to be rigidly supported below a ceiling surface;

(b) an elongated reflector pivotably attached to said housing lower side, said reflector having a generally concave shape formed with dual inner facing walls, one of said walls being a major length rear portion and the other said wall a minor length front portion, side end plates and a front opening;

(c) multiple reflecting facet surfaces in said major length rear portion and said minor length front portion having varying acute angles measured relative to a central vertical plane through said reflector and said light source, said angles on said major length rear portion being measured toward said light source and said angles on said minor length front portion being measured away from said light source;

(d) a light source centrally located within said reflector so as to be substantially enclosed by said reflector and by said end plates; and (e) a diffuser plate capable of filtering ultraviolet light covering said front opening of said reflector;

(f) said varying acute angles being chosen such that direct light emanating from said light source is reflected by said multiple reflecting facet surfaces;

(i) from an upper zone of said major length rear portion to the bottom and central portions of said wall surface;

(ii) from a lower zone of said major length rear portion to the central and upper portions of said wall surface;

(iii) from an upper zone of said minor length front portion to the central portion of said wall surface; and (iv) from a lower zone of said minor length front portion to said upper zone of said major length rear portion and then to the central portion of the wall surface; thereby illuminating said wall surface in an asymmetric pattern, so as to provide uniformly diffused light on said wall surface without producing hot spots, scallops or striations on said wall surface.

2. In a lighting fixture adapted for illuminating a generally rectangular planar surface having a top portion, a central portion and a bottom portion, said fixture including a top structure adapted to be attached to an external fixture support, said top structure supporting an elongated light source within an elongated reflector housing the improvement comprising;

(a) a major length rear concave curved reflector depending outwardly and downwardly from said top structure and terminating approximately at a central vertical plane passing through the axis of said light source;

(b) a minor length front concave curved reflector depending outwardly and downwardly from said top structure and terminating at a vertical plane so as to form a front opening between said major length rear reflector and said minor length front reflector;

(c) said major length rear reflector having an upper zone of angled light reflecting facets beginning near said light source and ending at the beginning of a lower zone of angled light reflecting facets wherein the angles of said facets in said upper zone of said major length rear reflector, measured as positive acute angles from said vertical plane towards said light source, decrease from the beginning of said upper zone through the vertical to the end of said upper zone, said decreasing angles being chosen to reflect direct light from said source through said opening onto said central and bottom portions of said planar surface and wherein the angles of said facets in said lower zone of said major length rear reflector, measured as negative acute angles from said vertical plane away from said light source, decrease negatively from the beginning of said lower zone to the end of said lower zone, said negatively decreasing angles being chosen so as to reflect direct light from said source through said opening onto said central and top portions of said planar surface; and (d) said minor length front reflector having an upper zone of angled light reflecting facets beginning near said light source and ending at the beginning of a lower zone of angled light reflecting facets wherein the angles of said facets in said upper zone of said minor length front reflector, measured as positive acute angles from said vertical plane towards said light source, decrease from the beginning of said upper zone to the end of said upper zone, said decreasing angles being chosen so as to converge direct light from said source near said front opening and thence diverge said light onto said central and top portions of said planar surface and wherein the angles of said facets in said lower zone of said minor length front reflector measured as negative acute angles from said vertical plane away from said light source, decrease negatively from the beginning of said lower zone to the end of said lower zone, said decreasing negative angles being chosen so as to reflect direct light from said source onto facets of said upper zone of said major length rear reflector and thence onto said central portion of said planar surface, thereby producing an asymmetric light pattern which provides a substantially uniform distribution of light on said surface.

3. A lighting fixture according to claim 2, wherein the light rays reflected from said facets through said opening in (i) said major length rear upper zone are substantially parallel, (ii) said major length rear lower zone are substantially parallel, (iii) said minor length front upper zone converge near the upper portion of said opening, and (iv) said minor length front lower zone is first reflected off the lower facets in said major rear upper zone and are substantially parallel.

4. A lighting fixture according to claim, 2 wherein said angles of the light reflecting facets in (i) said major length rear upper zone decrease from approximately 43 degrees to approximately −5 degrees, (ii) said major length rear lower zone decrease negatively from approximately −43 degrees to approximately −5 degrees, (iii) said minor length front upper zone decrease from approximately 81 degrees to approximately 55 degrees, and (iv) said minor length front lower zone decrease from approximately −10 degrees to approximately 0 degrees.

5. A lighting fixture according to claim 2, wherein the direct light from said source is reflected by said facets through said opening at angles measured at the facet from said vertical plane toward said light source, from (i) said major length rear upper zone of approximately 27 to 35 degrees;

(ii) said major length rear lower zone of approximately 72 to 100 degrees;

(iii) said minor length front lower zone and said lower facets of said major length rear upper zone of approximately 58 to 66 degrees; and (iv) said minor length front upper zone of approximately −23 to −27 degrees at angles measured at the facet face from said vertical plane away from said light source.

6. A lighting fixture in accordance with claim, 2 wherein said fixture is adapted to be pivotally mounted adjacent the ceiling of a room so as to illuminate a wall surface of said room.

7. A lighting fixture according to claim 4, wherein (i) said major length rear upper zone has approximately 14 facets, (ii) said major length rear lower zone has approximately 9 facets, (iii) said minor length front upper zone has approximately 5 facets, and (iv) said minor length front lower zone has approximately 4 facets.

* * * * *